US007076813B2

(12) United States Patent
Stetson

(10) Patent No.: US 7,076,813 B2
(45) **Date of Patent: *Jul. 18, 2006**

(54) POOL SKIMMER

(76) Inventor: Michael A. Stetson, 32535 Branbel Ct., Lake Elsinore, CA (US) 92532

( * ) Notice: Subject to any disclaimer, the term of this patent is extended or adjusted under 35 U.S.C. 154(b) by 0 days.

This patent is subject to a terminal disclaimer.

(21) Appl. No.: 11/124,826

(22) Filed: May 9, 2005

(65) Prior Publication Data

US 2005/0235408 A1 Oct. 27, 2005

Related U.S. Application Data

(63) Continuation-in-part of application No. 10/612,745, filed on Jul. 2, 2003.

(51) Int. Cl.
*E04H 4/00* (2006.01)

(52) U.S. Cl. ..... 4/508; 4/509; 4/506; 4/512; 4/513

(58) Field of Classification Search ..... 4/506–510, 4/512, 513, 488, 496; 210/169; 137/624.14
See application file for complete search history.

(56) References Cited

U.S. PATENT DOCUMENTS 2,809,752 A * 10/1957 Leslie ..... 210/169
2,826,307 A 3/1958 Pace
2,900,079 A 8/1959 Pace
3,616,468 A 11/1971 Takacs
3,668,713 A * 6/1972 Baker ..... 4/512
3,668,714 A * 6/1972 Baker ..... 4/510
3,910,840 A 10/1975 Adam
4,146,937 A * 4/1979 Baker ..... 4/508
4,212,740 A 7/1980 Greene
4,225,436 A 9/1980 Cseh
4,454,035 A 6/1984 Stefan
4,494,257 A * 1/1985 Peirish ..... 4/508
4,818,389 A 4/1989 Tobias et al.
4,839,050 A 6/1989 Beard et al.

(Continued)

*Primary Examiner*—Khoa D. Huynh
(74) *Attorney, Agent, or Firm*—Stetina Brunda Garred & Brucker

(57) ABSTRACT

A skimmer system is provided which includes a reservoir, an inlet, a reservoir pump and a weir. The skimmer system may be attached to a tank having fluid therein. The fluid in the tank defines a tank fluid surface, and the fluid in the reservoir defines a reservoir fluid surface. The reservoir receives fluid from the tank via the inlet, and the tank receives fluid from the reservoir via the reservoir pump. When the skimmer system is activated, the level of the reservoir fluid surface may be maintained below the level of the tank fluid surface. The inlet edge is located below the level of the tank fluid surface. The inlet surface may decline away from the tank to direct the fluid from the tank to the reservoir. The filter is positioned between the inlet and the reservoir to retain particulate within the fluid. The weir defines a weir edge. The weir edge may be parallel to and substantially below the level of the tank fluid surface to allow particulate in the fluid to pass under the weir when the reservoir pump is activated and to prevent particulate in the fluid from passing under the weir when the reservoir pump is deactivated. The filter may be serviced through an access opening formed in a fabricated surface above the filter and covered by a cover.

20 Claims, 6 Drawing Sheets

U.S. PATENT DOCUMENTS

| | | | |
|---|---|---|---|
| 5,336,400 | A | 8/1994 | Patrice |
| 5,581,826 | A | 12/1996 | Edwards |
| 5,888,386 | A | 3/1999 | Enright et al. |
| 6,158,064 | A | 12/2000 | Downs |
| 6,214,217 | B1 | 4/2001 | Sliger, Jr. |
| 6,383,374 | B1 | 5/2002 | Splendorio |
| 6,592,756 | B1 | 7/2003 | Felix, Jr. |

* cited by examiner

POOL SKIMMER

CROSS-REFERENCE TO RELATED APPLICATIONS

This is a continuation-in-part of application Ser. No. 10/612,745, filed Jul. 2, 2003, the entire contents of which are expressly incorporated herein by reference.

STATEMENT RE: FEDERALLY SPONSORED RESEARCH/DEVELOPMENT

Not Applicable

BACKGROUND OF THE INVENTION

The present invention relates generally to circulation systems which cause fluid to flow through various system components for the purposes of clarifying, heating, purifying and returning the fluid back to the original body of fluid, and more particularly, to a pool skimmer system which cause water to flow through a basket to remove debris floating on the surface of a pool and to return the water back to the pool.

In the context of swimming pools, the water in the pool is filtered through a circulation system to filter debris from the water. In particular, the circulation system has a reservoir attached adjacent to the pool. The reservoir and the pool are attached to each other through an inlet. Water is filled into the pool to a level above the inlet such that the water from the pool passes through the inlet into the reservoir. In this regard, the inlet is partially submerged under the surface of the water in the pool, and the level of the water in the pool is equal to the level of the water in the reservoir. The reservoir is connected to a pump which draws water from the pool side of the inlet to the reservoir side of the inlet. The reservoir additionally has a filter which traps any debris floating on the surface of the water and in the water. When the circulation system is deactivated, the debris trapped in the filter is trapped in the reservoir by a rotatable weir which is located at the inlet and only rotates toward the reservoir. In this regard, the weir allows passage of water and debris from the pool to the reservoir but not from the reservoir to the pool.

The filter discussed above requires regular cleaning. For this purpose, an access opening is provided directly above the filter. The access opening is formed in a deck which surrounds the pool. Multiple techniques are employed in the prior art to cover the access opening. An example of a cover is disclosed in U.S. Pat. No. 6,393,771 ('771 Patent) which is expressly incorporated herein by reference. Briefly, the '771 Patent discloses a cover comprising a frame and a cap member. The deck is modified with an opening sized and configured to receive the frame, and the cap member is sized and configured in conjunction with the frame to be removeably engagable therefrom.

In the context of swimming pools, the above described circulation system is typical of circulation systems in current use. To trap debris floating on the surface of the pool water, the circulation system requires that the pump be extraordinarily powerful such that debris floating on the pool water are drawn toward and pass through the inlet. Unfortunately, debris is drawn toward but does not pass through the inlet. Instead, the debris floating on the water of the pool collects on both sides of the inlet. Accordingly, there is a need for an improved skimmer system.

BRIEF SUMMARY OF THE INVENTION

The present invention alleviates the deficiencies in the prior art. In accordance with the present invention, there is provided a skimmer system attached to a tank having fluid therein. The system comprises a reservoir, an inlet, a filter, a reservoir pump and a weir. The fluid in the tank defines a tank fluid surface, and the fluid in the reservoir defines a reservoir fluid surface. The reservoir receives fluid from the tank via the inlet, and the tank receives fluid from the reservoir via the reservoir pump. The level of the reservoir fluid surface is maintained below the level of the tank fluid surface when the skimmer system is turned on such that fluid in the tank and debris floating in the tank fluid is funneled into the skimmer system, debris is trapped by the filter, and only the fluid but not the debris is returned to the tank.

The inlet defines an inlet edge and an inlet surface. The inlet edge is located below the level of the tank fluid surface, and the inlet surface declines away from the tank to transfer the fluid from the tank to the reservoir. The reservoir pump transfers fluid from the reservoir to the tank. The filter is positioned between the inlet and the reservoir to retain particulate/debris therein.

The weir defines a weir edge which may be positioned above the inlet surface. The weir edge may be parallel to and substantially below the level of the tank fluid surface to allow particulate/debris in the fluid to pass under the weir when the reservoir pump is activated and to prevent particulate/debris in the fluid from passing under the weir from the reservoir side to the tank side of the inlet when the reservoir pump is deactivated.

The inlet edge may be set about one inch below the level of the tank fluid surface. An opening of the inlet is defined by the inlet edge and a height. The inlet edge may be about twenty four inches, and the height may be about four inches. The inlet surface may have a decline angle of about 20 degrees. Although the inlet surface is shown as a flat surface, it is also contemplated within the scope of the present invention that the inlet surface may have other configurations such as stair-stepped, (See FIG. 14), convex (See FIG. 15) or concave as long as the fluid from the tank may flow into the area above the filter.

The level of the tank fluid surface may be equal to the level of the reservoir fluid surface when the skimmer system is not on (i.e., reservoir pump is not activated). At this moment, the rate of fluid transfer through the inlet from the tank to the reservoir and through the reservoir pump from the reservoir to the tank may be equal to zero. Once the reservoir pump is activated (i.e., the skimmer system is turned on), the level of the reservoir fluid surface may begin to decrease in relation to the level of the tank fluid surface. Eventually, for a pump which transfers fluid from the reservoir to the tank at a constant rate, the fluid transfer rate of the fluid through the inlet will equal the fluid transfer rate of the fluid through the reservoir pump, and a steady state condition will occur. Preferably, the level of the reservoir fluid surface is about three inches below the level of the tank fluid surface at the steady state condition.

Over time, as the skimmer system operates at this steady state condition, fluid may evaporate thereby decreasing the level of the reservoir fluid surface. If fluid continues to evaporate out of the tank and reservoir, and the level of the reservoir fluid surface reaches the entrance of the reservoir pump, then air will be pumped through the pump (i.e., dry pump condition) which is not desirable. To prevent the dry pump condition, a fluid level regulator, which is in communication with an inlet fluid valve (see FIG. 1), may activate and deactivate the inlet fluid valve to replenish the tank and reservoir with fluid as fluid evaporates from the tank and reservoir. The inlet fluid valve is connected to an outside fluid source which when opened fills the tank and reservoir with fluid. The fluid level regulator may be attached to the reservoir and may monitor the level of the reservoir fluid surface such that the inlet fluid valve is opened when the level of the reservoir fluid surface is too low (i.e., more than about three inches below the level of the tank fluid surface) and is closed when the reservoir has been filled with a sufficient amount of fluid (i.e., the level of the reservoir fluid surface is about three inches below the level of the tank fluid surface). For example, the fluid level regulator may open the inlet fluid valve when the level of the reservoir fluid surface is greater than about four inches below the level of the tank fluid surface. As the fluid fills the reservoir, the level of the reservoir fluid surface will rise. The inlet fluid valve may remain open until the fluid level regulator senses that the level of the reservoir fluid surface is about three inches below the level of the tank fluid surface.

Alternatively, the fluid level regulator may monitor the level of the reservoir fluid surface and control (i.e., activate or deactivate) the reservoir pump to maintain the level of the reservoir fluid surface approximately three inches below the level of the tank fluid surface. In this alternative embodiment, a fluid transfer rate of the reservoir pump may be greater than a fluid transfer rate of the inlet. The fluid level regulator activates the reservoir pump when fluid level regulator senses that the level of the reservoir fluid surface is about three inches or less below the level of the tank fluid surface and deactivates the reservoir pump when fluid level regulator senses that the level of the reservoir fluid surface is greater than about three inches below the level of the tank fluid surface. The reservoir pump may cycle between the activated and deactivated states when the skimmer system is turned on.

In a further alternative embodiment, the reservoir pump which may have a fluid transfer rate greater than a fluid transfer rate of the inlet may be activated for a set period of time to drain the reservoir and deactivated to allow the reservoir to refill. The reservoir pump may cycle between the activated and deactivated states when the skimmer system is turned on.

The skimmer system may further comprise a conical tray with an aperture at the center thereof. The tray may be positioned above the reservoir. The aperture may be sized and configured to receive and removeably secure the filter. The tray is located at a level below the inlet surface so as to receive the fluid transferred through the inlet.

The reservoir may have a cubular or a cylindrical configuration. The reservoir may have a capacity of about 12 to 16 cubic feet. In relation to the cylindrical configuration, the reservoir may have a diameter of about 30 inches. In relation to the cubular configuration, the reservoir may have a base dimension of thirty inches by thirty inches.

The skimmer system may further comprise an overflow valve attached to the reservoir one inch above the inlet edge to drain fluid from the reservoir when the level of the reservoir fluid surface is greater than one inch above the inlet edge.

The skimmer system may further comprise a cover which may be positioned above the filter for closing a utility access opening formed in a fabricated surface surrounding the tank to service the filter. The access opening may extend through the fabricated surface having an exposed appearance. The cover may comprise a cap member engagable within the opening. The cap member may have a top cavity adapted to receive a selected material. The cap member may further have at least one hand/finger engagable grip for lifting the cap member and the selected material placed in the top cavity from the opening. The cap member with the material disposed within the top cavity provides an exposed surface having an appearance substantially identical to the exposed appearance of the fabricated surface.

The cap member may have two hand/finger engagable grips which are a pair of hollow tubes having holes extending to a flared bottom cavity for gripping the cap member with human fingers. The two hand/finger engagable grips may be formed opposite each other and aligned with a center of gravity of the cap member and the selected material placed in the top cavity.

The cap member may have a bottom plate, a lateral wall, and a plurality of support posts. The bottom plate and the lateral wall define the top cavity, and the plurality of support posts may be disposed within top cavity wherein each post is attached to both the bottom plate and the lateral wall.

The selected material may be castable, dirt or other material having an appearance identical or substantially similar to the exposed appearance of the fabricated surface. The cap member may additionally have at least one hole for draining moisture from the material placed within the top cavity of the cap member. In particular, the drain hole may be an aperture through the bottom plate.

In another embodiment of the present invention, an access assembly for constructing a covered access opening is provided. The access opening extends through a fabricated surface having an exposed appearance. The assembly comprises a frame and a cap member. The frame may have may have a side support for lining an access opening through the fabricated surface. The frame may also have a bottom support wherein the side support and the bottom support are sized and configured to receive the cap member. The cap member may have a top cavity adapted to receive a selected material. The cap member may further have at least one hand/finger engageable grip for lifting the cap member and the material placed in the cavity of the cap member from the opening. The hand/finger engagable grip(s) may be formed at a periphery of the cap member.

Preferably, the cap member may have two hand/finger engageable grips which are a pair of hollow tubes. The hollow tubes may have holes extending through the cap member to a flared bottom cavity for gripping the cap member with human fingers. The two hand/finger engagable grips may be formed opposite each other and aligned with a center of gravity of the cap member and the selected material placed in the top cavity.

In another embodiment of the present invention, an access assembly may comprise a cap member and a frame. The frame may have a side support for lining an access opening through the fabricated surface and a bottom support wherein the side support and the bottom support are sized and configured to receive the cap member.

The cap member and the frame may collectively define a hollow tube with a flared bottom cavity for receiving a finger of a human hand to lift the cap member out of the frame. The cap member may have formed about its periphery at least one recess which extends from the top of the cap member to the flared bottom cavity. A top view of the recess may have a semi circular configuration. The flared bottom cavity may be formed at the bottom of the cap member such that a finger may lift the cap member out of the frame.

In another embodiment of the present invention, an access assembly may comprise a cap member and a frame similar to the above mentioned access assemblies. Moreover, the cap member and the frame may collectively define the hollow tubes or hand/finger engageable grip(s). In particular, a flared bottom cavity may be formed about a periphery of the cap member. A side support of the frame may be recessed to provide access to the flared bottom cavity when the cap member is received by the frame.

When the cap member is inserted into the frame, the flared bottom cavity may not be aligned to the recess found in the side support. As such, the cap member may be rotated until the recess is aligned to the flared bottom cavity such that a person may lift the cap member out of the frame by inserting his/her fingers into the recess and grasping the flared bottom cavity.

A plurality of flared bottom cavities may be formed on the cap member. Similarly, a plurality of recesses may be formed in the side support of the frame. The plurality of flared bottom cavities may be formed about the cap member in a corresponding manner to the recesses formed in the side support of the frame.

DETAILED DESCRIPTION OF THE INVENTION

FIGS. 1–13 are for the purpose of illustrating the preferred embodiments of the present invention, and not for the purpose of limiting the present invention. The following discussion of the preferred embodiments of the present invention will describe the preferred embodiments in the context of residential and commercial pools. However, the present invention is not limited to residential and commercial pools. Rather, they may be expanded into other uses. For example, the preferred embodiment of the present invention may be applicable to water, oil or other fluidic tanks.

Figure 1:
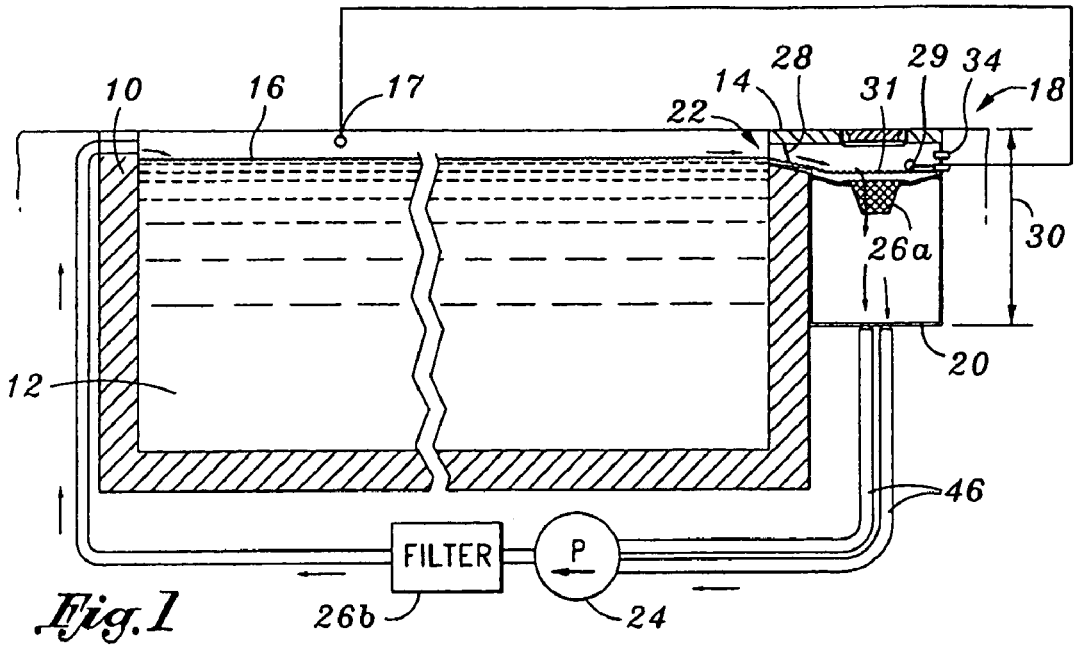
FIG. 1 illustrates a front elevational view of a skimmer system attached to a tank and a cover/access assembly.

The residential or commercial pool may be a permanently installed pool, in-ground pool, above-ground-pool or an on-ground pool. For purposes of this discussion, the pool which contains the body of water shall be referred to as the tank 10, and the water within the pool shall be referred to as the fluid 12, as shown in FIG. 1. The area beside the tank 10 is the fabricated surface 14. The fluid 12 when filled into the tank 10 defines a tank fluid surface 16. The level of the tank fluid surface 16 changes over time due to evaporation or user intervention. Typically, the tank 10 will have an open top. The tank has an inlet fluid valve 17 (see FIG. 1) which may be turned on automatically through a remote controller or manually through user intervention. The inlet fluid valve 17 fills the tank 10 with fluid from an outside source to raise the level of the tank fluid surface 16. The rate at which the fluid 12 is filled into the tank 10 defines a fluid transfer rate of the inlet fluid valve 17. The fluid transfer rate is the amount of fluid 12 that is transferred between two points per a unit of time. For example, the fluid transfer rate of the inlet fluid valve 17 is the amount of fluid 12 that may be transferred from the outside source into the tank 10 per a unit measurement of time.

FIG. 1 illustrates the skimmer system 18. The skimmer system 18 may comprise a reservoir 20, inlet 22, reservoir pump 24, filter 26*a*, weir 28 and a fluid level regulator 29. The skimmer system 18 may be incorporated into the circulation system of the tank 10.

The reservoir 20 may be generally located adjacent to the tank 10, and is generally located below the level of the tank fluid surface 16 when the tank 10 is full, as shown in FIG. 1. When the reservoir 20 is filled with fluid, the fluid defines a reservoir fluid surface 31. The reservoir 20 may have a capacity to hold approximately 12 to 16 cubic feet of fluid 12. The reservoir 20 may have a cylindrical configuration or a cubular configuration. In relation to the cylindrical reservoir 20, the diameter of the cylindrical reservoir 20 may be approximately thirty inches, and the height 30 of the cylindrical reservoir 20 may be approximately thirty four inches measured from the bottom of the reservoir 20 to the top of the fabricated surface 14. In relation to the cubular reservoir, the base of the reservoir 20 may have a dimension of about thirty inches by thirty inches, and the height 30 of the cubular reservoir may be about thirty four inches measured from the bottom of the reservoir to the top of the fabricated surface 14.

Figure 2:
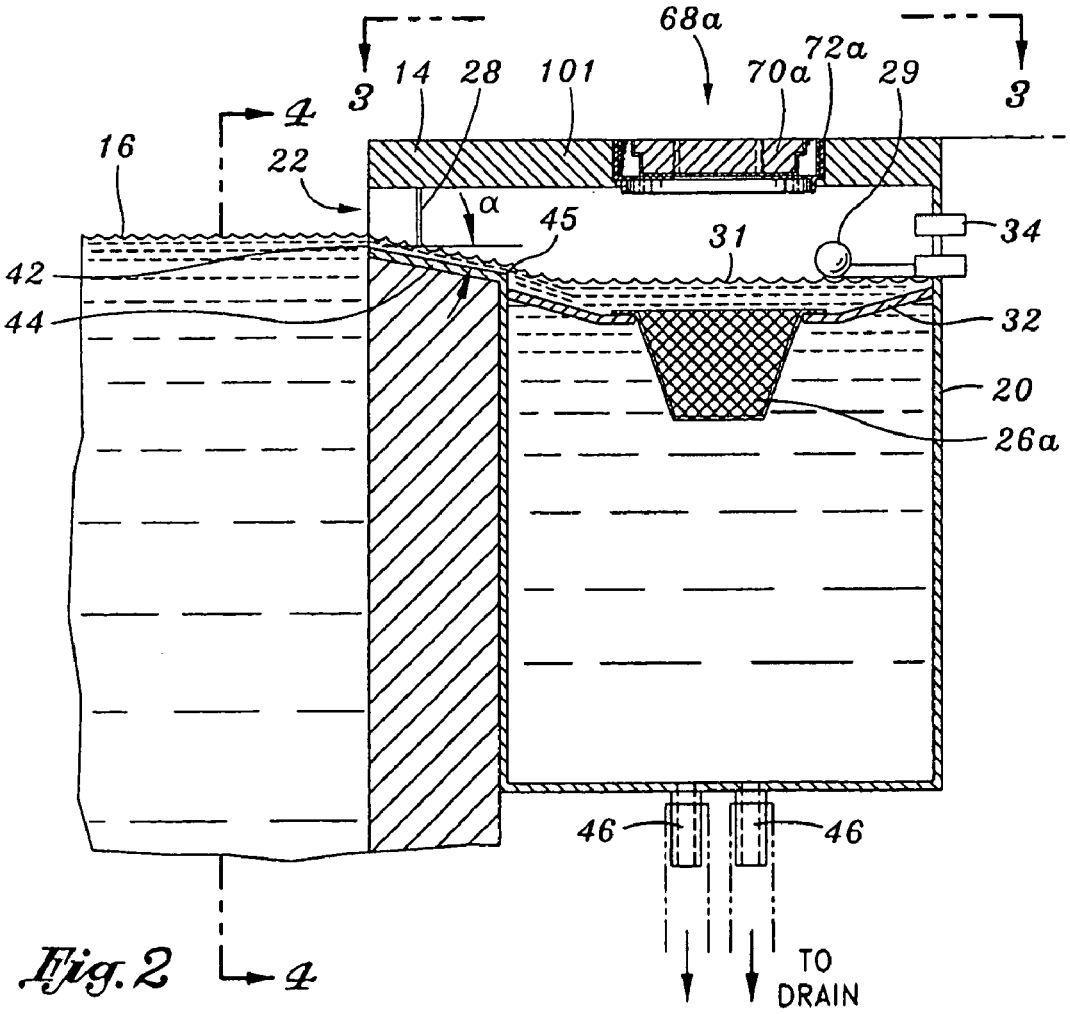
FIG. 2 is a cross sectional view of the skimmer system illustrated in FIG. 1.

Referring to FIG. 2, a tray 32 may be attached to the reservoir 20 at its upper portion. The tray 32 may have an inverted conical configuration. The center of the tray 32 may have an aperture.

The filter 26*a* may be attached to tray 32. In particular, the filter 26*a* may be attached to the tray 32 at the aperture. The aperture of the tray 32 may be sized and configured to receive and removeably secure the filter 26*a* to the tray. The filter 26 may be a standard pool basket, a wire mesh filter, a permanent medium filter, diatomaceous earth filter, cartridge filter or vacuum filter. For example, as shown in FIG. 2, the filter 26*a* is a standard pool basket.

The fluid level regulator 29 may be attached to reservoir 20 to regulate the level of the reservoir fluid surface 31 by activating and deactivating an inlet fluid valve 17 based on a sensed level of the level of the reservoir fluid surface. As shown in FIG. 1, the fluid level regulator 29 may be in communication with the inlet fluid valve 17. The fluid level regulator 29 monitors and regulates the level of the reservoir fluid surface 31 to be sufficiently below the level of the tank fluid surface 16. For example, the fluid level regulator 29 regulates the level of the reservoir fluid surface 31 to be about three inches below the level of the tank fluid surface 16. The fluid level regulator 29 may be a ballcock such as a float-arm ball type or a float-cup type. The fluid level regulator 29 may have an up position and a down position. The up position may deactivate the inlet fluid valve 17, and the down position may activate the inlet fluid valve 17.

An overflow valve 34 may be attached to the reservoir 20, as shown in FIGS. 1 and 2. The overflow valve 34 may have an opened and closed position wherein the fluid 12 exits the reservoir 20 or is retained within the reservoir 20, respectively. The overflow valve 34 may be a spigot which may be automatically or manually controlled between the opened and closed positions. The overflow valve 34 drains the fluid from the tank 10 and reservoir 20 when the levels of the tank and reservoir fluid surface 16, 31 are too high.

Figure 4:
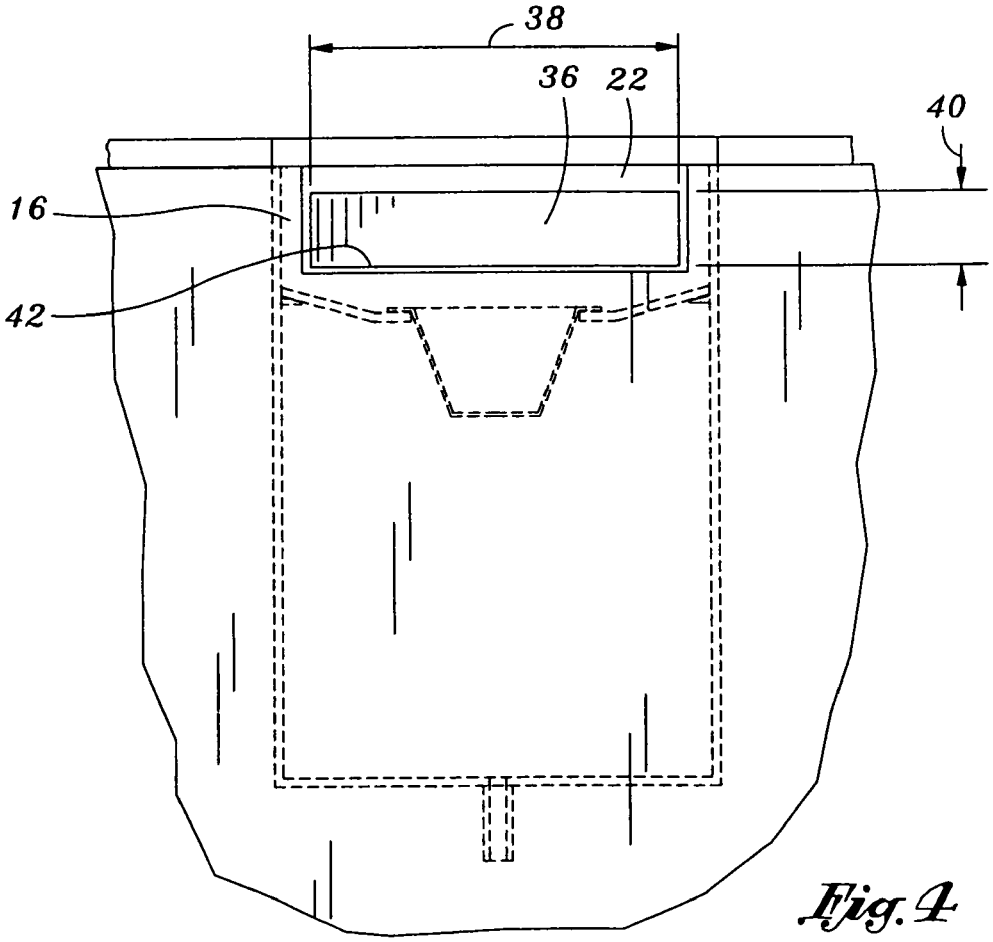
FIG. 4 is a side elevational view of an inlet illustrated in FIG. 2.

Referring to FIGS. 1, 2 and 4, an inlet 22 may be attached to the reservoir 20. As shown in FIG. 4, the inlet defines an opening 36. The opening 36 has a width 38 and a height 40. The inlet 22 further defines an inlet edge 42. The width 38 of the edge 42 (i.e., the opening) may be about twenty four inches. The height 40 of the opening may be about four inches. The inlet edge 42 may be located approximately one inch below the level of the tank fluid surface 16, as shown in FIG. 2. When the tank 10 is empty, the inlet fluid valve 17 may be turned on until the level of the tank fluid surface 16 is approximately one inch above the inlet edge 42. Additionally, the overflow valve 34 may be attached to the reservoir 20 at about one inch above the inlet edge 42. Accordingly, if the levels of the tank fluid surface 16 and the reservoir fluid surface 31 are more than one inch above the inlet edge 52, then the fluid 12 may be drained out through the overflow valve 34 to maintain the tank and reservoir fluid surface to be one inch above the inlet edge 42.

Figure 3:
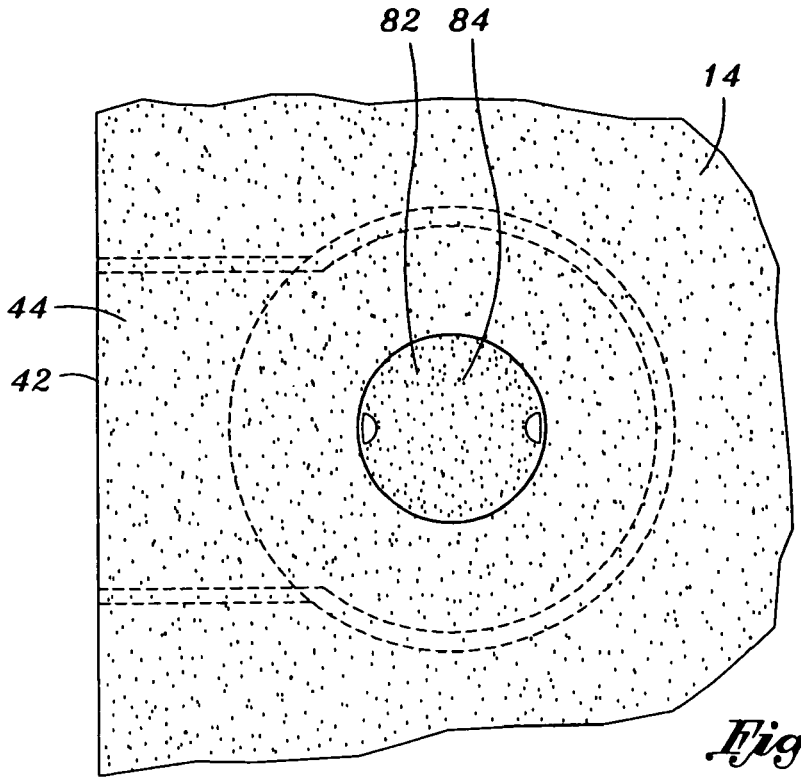
FIG. 3 is a top view of a fabricated surface and a first embodiment of a cover/access assembly shown in FIG. 2.
Figure 14:
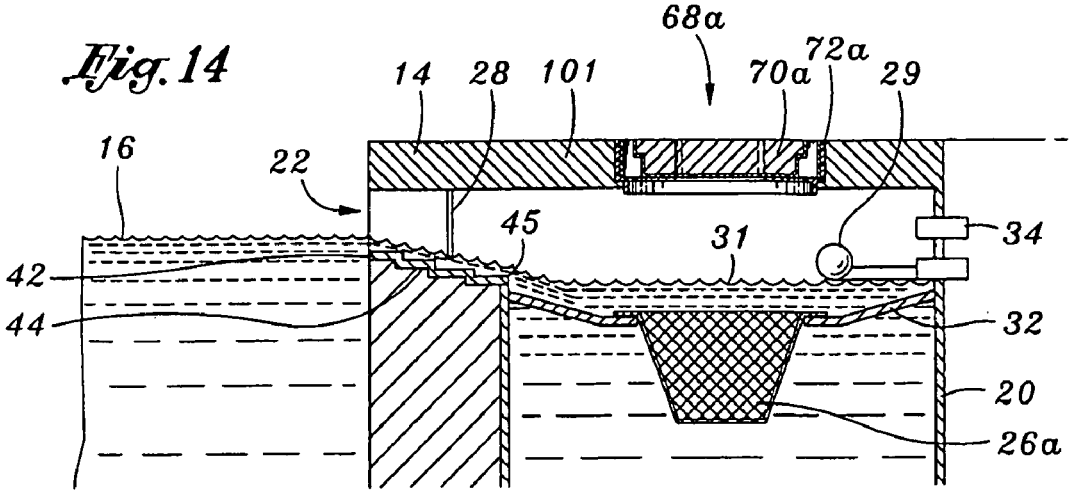
FIG. 14 illustrates a front elevational view of a skimmer system attached to a tank wherein the inlet surface has a stair stepped configuration.
Figure 15:
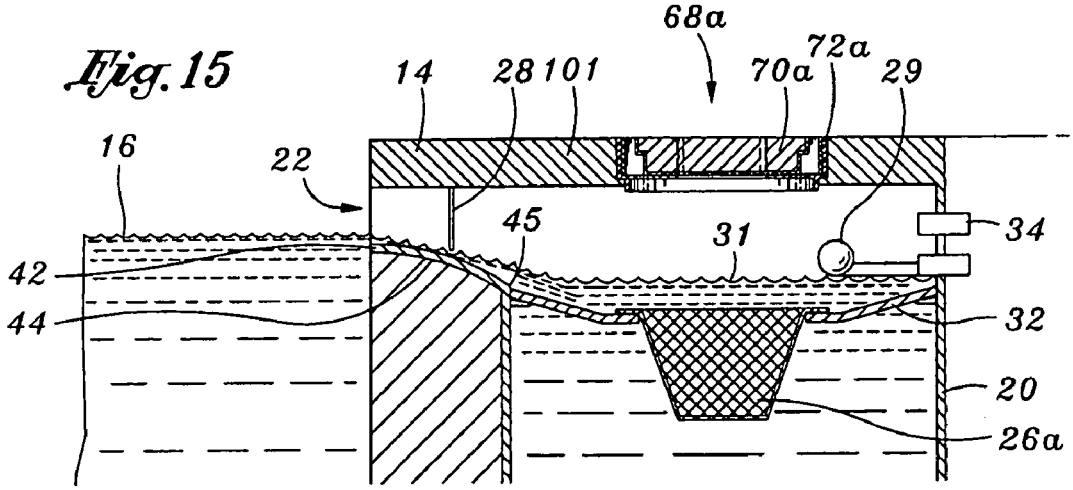
FIG. 15 illustrates a front elevational view of a skimmer system attached to a tank wherein the inlet surface has a concave configuration.

The inlet edge 42 may be connected to an inlet surface 44, as shown in FIGS. 2 and 3. The inlet surface 44 declines away from the inlet edge 42. The rate of declination of the inlet surface 44 may be about alpha (e.g., twenty degrees, etc.). (See FIG. 2). For example, the horizontal component of the inlet surface 44 is about eight inches, and the vertical component of the inlet surface 44 is about three inches. Although inlet surface 44 is shown as being a generally flat surface, it is also contemplated that the inlet surface 44 may have any configuration (e.g., stair-step, curved, etc.; See FIGS. 14 and 15) as long as a terminal edge 45 (see FIG. 2) of the inlet surface 44 is lower than the inlet edge 42 such that the fluid 12 may cascade downward into the reservoir 20.

The inlet 22 and the reservoir 20 may be positioned relative to each other such that the inlet 22 directs the fluid 12 onto the tray 32 and eventually through the filter **26*a* and into the reservoir 20. The tray 32 may be located below and adjacent the inlet surface 44 such that as fluid 12 initially fills the tank 10, the level of the tank fluid surface is raised above the inlet edge 42 and the fluid 12 of the tank 10 begins to spill into the reservoir 20 through the inlet 22 due to pressure on the tank side and gravity on the reservoir side of the inlet 22. The rate at which the fluid 12 is drawn through the inlet 22 defines the fluid transfer rate of the inlet 22. The fluid transfer rate of the inlet 22 is a function of the distance at which the inlet edge 42 is located below the tank fluid surface 16, the width 38 of the inlet edge 42, and the viscosity of the fluid 12. The fluid 12 in the tank 10 is considered to be the influent side of the inlet 22, and the fluid 12 in the reservoir 20 is considered to be the effluent side of the inlet 22**.

The weir 28 may be located above the inlet surface 44, as shown in FIG. 2. The weir 28 may be a square plate which extends across the whole width 38 (see FIG. 4) of the inlet opening 36. The weir 28 may be attached to the fabricated surface 14 and extend downward toward the inlet surface 44. The weir 28 may extend substantially below the level of the tank fluid surface 16. The weir 28 may extend toward but does not touch the inlet surface 44 so as to allow particulates/debris within the fluid 12 and on the tank fluid surface 16 to pass under the weir 28 when fluid 12 is being transferred from the tank 10 to the reservoir 20. In the context of pools, by way of example and not limitation, the particulates may be leaves and dead insects. The particulates may pass under the weir 28 due to the force of the fluid 12 being transferred from the tank 10 to the reservoir 20. The weir 28 may be fixedly attached to the fabricated surface 14. Alternatively, the weir 28 may be rotatably attached to the fabricated surface 14. In particular, the weir 28 may rotate only toward the reservoir 20. The normal position of the weir 28 may be vertical, as shown in FIG. 2.

As stated above, the fluid level regulator 29 monitors and regulates the level of the reservoir fluid surface 31 to be sufficiently below the level of the tank fluid surface 16. In this regard, the level of the reservoir fluid surface 31 is sufficiently below the level of the tank fluid surface 16 as long as the fluid 12 in the tank 10 and the particulates in the fluid 12 are able to pass through the inlet opening 36 and under the weir 28.

Attached to the bottom of the reservoir 20 are at least one and preferably two tubes 46 which drain the reservoir 20 of fluid 12, as shown in FIGS. 1 and 2. Each tube 46 may have a two inch diameter. The tubes 46 may subsequently be attached to the reservoir pump 24 (see FIG. 1). When the reservoir pump 24 is activated, the reservoir pump 24 may transfer fluid 12 from the reservoir 20 to the tank 10. The reservoir pump 24 defines a fluid transfer rate which defines the rate at which the fluid 12 is transferred from the reservoir 20 to the tank 10. In this regard, the fluid 12 in the tank 10 is considered to be the effluent side of the reservoir pump 24, and the fluid 12 in the reservoir 20 is considered to be the influent side of the reservoir pump 24. The reservoir pump 24 may subsequently be connected to a filter **26*b* (see FIG. 1). The filter 26*b* may subsequently be connected to the tank 10**.

The fluid transfer rate of the reservoir pump 24 may preferably be constant, or in the alternative, variable. In the context of pools, the fluid transfer rate of the reservoir pump 24 and the capacity of the reservoir 20 to contain fluid 12 are sized in relation to each other such that the reservoir pump 24 does not pump air.

In relation to reservoir pumps 24 having a constant fluid transfer rate, the fluid transfer rate of the reservoir pump 24 may be equal to the fluid transfer rate of the inlet 22 when the level of the reservoir fluid surface 31 is sufficiently below the level of the tank fluid surface 16. When the tank 10 and reservoir is filled with fluid 12 and the reservoir pump 24 is initially activated, then the level of the tank fluid surface 16 will rise which causes the fluid transfer rate of the inlet 22 to rise until the fluid transfer rate from the tank 10 to the reservoir 20 through the inlet 22 is equal to the fluid transfer rate from the reservoir 20 to the tank 10 via the reservoir pump 24. The pump 24 and the inlet 22 eventually reaches a steady state condition in which the level of the tank fluid surface 16 is above the level of the reservoir fluid surface 31 a set distance such as about three inches. The reservoir pump 24 may be sized in relation to the fluid transfer rate of the inlet 22 such that the level of the reservoir fluid surface 31 is sufficiently below the level of the tank fluid surface at the steady state condition. For example, the reservoir pump 24 may be sized such that the level of the reservoir fluid surface 31 is about three inches below the level of the tank fluid surface 16 at the steady state condition.

In relation to reservoir pumps 24 having variable fluid transfer rates, the fluid level regulator 29 varies the fluid transfer rate of the reservoir pump 24 as a function of the level of the reservoir fluid surface 31. The fluid level regulator 29 varies the fluid transfer rate of the reservoir pump 24 such that the level of the reservoir fluid surface 31 is sufficiently below the level of the tank fluid surface. For example, the fluid level regulator 29 varies the fluid transfer rate of the reservoir pump 24 such that the level of the reservoir fluid surface 31 is about three inches below the level of the tank fluid surface 16.

A general operation of the above described components will be discussed. When the tank 10 is empty, the inlet fluid valve 17 is activated such that fluid 12 may fill the tank 10. The inlet fluid valve 17 is maintained in the opened position such that the fluid 12 fills the tank 10 till the level of the tank fluid surface 16 is about one inch above the inlet edge 42. At this time, the level of the tank fluid surface 16 is equal to the level of the reservoir fluid surface 31.

The skimmer system 18 is activated thereby turning the reservoir pump 24 on such that fluid from the reservoir 20 is being pumped from the reservoir 20 into the tank 10, lowering the level of the reservoir fluid surface 31, and slightly increasing the level of the tank fluid surface in relation to each other. As the reservoir pump 24 transfers fluid from the reservoir 20 to the tank 10, the fluid transfer rate of the inlet 22 increases until the fluid transfer rate of the inlet 22 is equal to the fluid transfer rate of the reservoir pump 24. Preferably, this steady state condition is reached when the level of the reservoir fluid surface 31 is approximately three inches below the level of the tank fluid surface 16.

As skimmer system 18 operates at this steady state condition, due to evaporation, the level of the reservoir fluid surface 31 may drop close to the opening of the tubes 46 connected to the reservoir pump 24 thereby producing a possible dry pump situation which is undesirable. To mitigate against the dry pump situation, the fluid level regulator 29 monitors the level of the reservoir fluid surface 16. If the level of the reservoir fluid surface 16 is too low (i.e., more than about three inches below the level of the tank fluid surface), then the fluid level regulator 29 may activate the inlet fluid valve 17 to fill the tank 10 and reservoir 20 with fluid. For example, if the fluid level regulator 29 senses that the level of the reservoir fluid level 31 is more than four inches below the level of the tank fluid surface 16 then the inlet fluid valve 17 may be activated thereby filling the tank 10 and reservoir 20. This raises the level of the reservoir fluid surface 31. The inlet fluid valve 17 may be activated until the level of the reservoir fluid surface 31 is about three inches below the level of the tank fluid surface 16.

Figure 16:
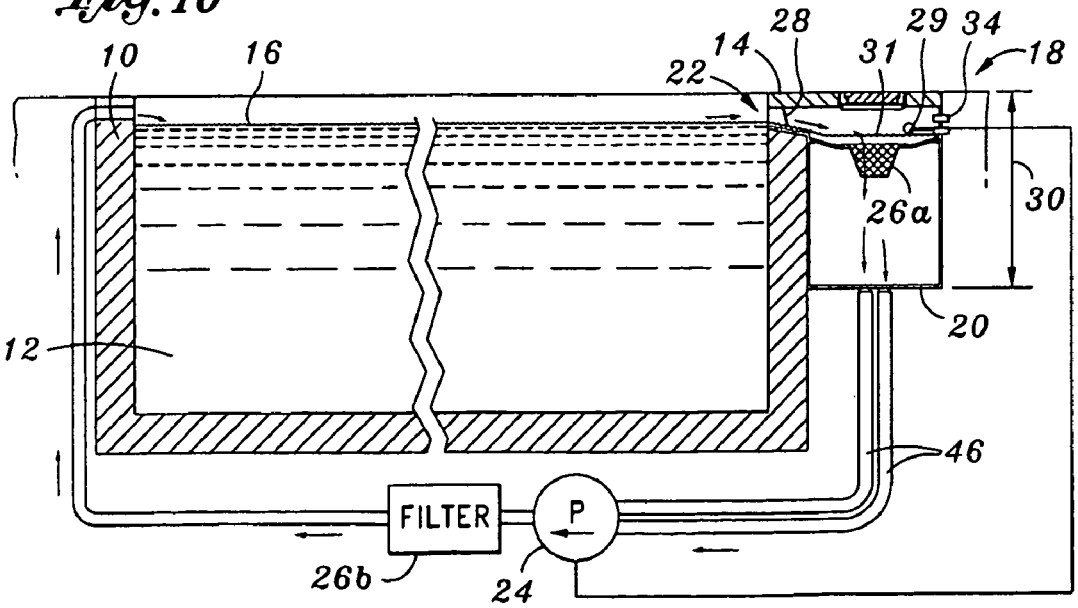
FIG. 16 illustrates a front elevational view of a skimmer system attached to a tank wherein the fluid level regulator activates and controls the reservoir pump.

In an alternate embodiment, the skimmer system 18 is initially activated and the fluid level regulator 29 monitors that the level of the reservoir fluid surface 31 is at the same level as the level of the tank fluid surface thereby activating the reservoir pump 24 to drain the reservoir 20. (See FIG. 16). The level of the reservoir fluid surface 31 is reduced and the level of the tank fluid surface 16 is increased while the reservoir pump 24 is active because the fluid transfer rate of the reservoir pump 24 is greater than the fluid transfer rate of the inlet 22. If the reservoir pump 24 is maintained in the active state and the fluid transfer rate of the inlet 22 is less than the fluid transfer rate of the reservoir pump 24, then the reservoir pump 24 will eventually transfer all of the fluid 12 from the reservoir 20 to the tank 10 creating a dry pump situation. To mitigate against the dry pump situation, the fluid level regulator 29 deactivates the reservoir pump 24 when the fluid level regulator 29 reaches the down position. In this alternative embodiment, the fluid level regulator 29 does not deactivate the reservoir pump 24 until the down position has been reached (i.e., when the level of the reservoir fluid surface approaches the entrance of the tubes 46) even though the level of the reservoir fluid surface 31 is more than three inches below the level of the tank fluid surface 16.

When the fluid level regulator 29 is in the down position, the reservoir pump 24 may be deactivated. Now, the fluid transfer rate of the inlet 22 is greater than the fluid transfer rate of the deactivated reservoir pump 24 thereby filling the reservoir 20 with fluid 12. The reservoir pump 24 will be maintained in the deactivated state until the fluid level regulator 29 indicates that the level of the reservoir fluid surface 31 is about three inches below the level of the tank fluid surface 16.

When the skimmer system 18 is activated, preferably, the inlet fluid valve 17 is cyclically activated and deactivated due to fluid evaporation or the reservoir pump 24 cycles between the active and deactivated state based on the level of the reservoir fluid surface 31. Additionally, particulates which float on the tank fluid surface 16 (i.e., particulates which have a lower density than the fluid) are drawn into the inlet 22 and trapped by the filter 26*a*. Additionally, particulates which float within the fluid 12 (i.e., particulates which have about the same density as the fluid) in the tank 10 are drawn into the inlet 22 and trapped by the filter 26*a*. Additionally, other fluid treatment components may be added to the skimmer system 18 such as a clarifier, heater and purifier.

When the skimmer system 18 is deactivated, the inlet 22 continues to draw fluid 12 from the tank 10 to the reservoir 20 until the levels of the tank fluid surface 16 and reservoir fluid surface 31 are equal. At this point, the particulates which have a lower density than the fluid 12 may not pass under the weir 28 from the reservoir 20 to the tank 10 because the weir extends from the fabricated surface 14 to below the level of the tank fluid surface 16. In this regard, the weir 28 extends substantially below the level of the tank fluid surface 16 as long as the particulates having a lower density than the fluid 12 cannot be transferred from the reservoir 20 to the tank 10 when the skimmer system 18 is deactivated.

One tank 10 may have multiple skimmer systems 18 attached thereto. For example, a plurality of skimmer systems 18 may be located equidistant around the circumference of the tank 10. When multiple skimmer systems 18 are attached to one tank 10, then the tubes 46 used to drain each reservoir 20 may be interconnected to a single reservoir pump 24.

The filter 26*a* needs to be cleaned out on a regular basis. As such, an access opening may be formed in the fabricated surface 14 above the filter 26*a*, as shown in FIGS. 1 and 2. The access opening may be formed directly above the filter 26*a* which is secured to the tray 32 of the reservoir 20. Referring to FIGS. 2, 5, 8 and 11, a cover 68*a, b, c* for closing the access opening is illustrated. The cover 68*a, b, c* includes a cap member 70*a, b, c* engageable within the access opening of the fabricated surface 14. The cover 68*a, b, c* is suitable for covering the access opening formed by the fabricated surface 14, however, the access opening is preferably formed with a frame 72*a, b, c* having an opening 74*a, b, c* disposed within the plane of the fabricated surface 14. To facilitate engagement of the cap member 70*a, b, c,* the frame 72*a, b, c* can be provided with a bottom support/rim 76*a, b, c* sized to engage a bottom plate 78*a, b, c* of the cap member 70*a, b, c.* The cap member 70*a, b, c* and frame 72*a, b, c* can be constructed from any material having sufficient stiffness and durability, such as metal, fiberglass, plastic, ceramic, wood, etc.

As shown in FIGS. 5–13, the cap member 70*a, b, c* has a substantially full top cavity 80*a, b, c* (see FIGS. 7, 10 and 13) for receiving a selected material 82 (see FIG. 3). The material 82 within the cavity 80*a, b, c* may be selected to provide an exposed surface 84 (see FIG. 3) having an appearance substantially identical with the exposed appearance of the fabricated surface 14. Additionally, when the selected material 82 is identical to the material of the fabricated surface 14, the exposed surface 84 and fabricated surface 14 will have compatible functional properties as well, such as respective coefficients of friction and coefficients of expansion. While a homogenous material 82 is shown in FIG. 3, it is, of course, to be understood that non-homogenous materials such as stone and mortar or tile and grout can also be placed within the cavity 80*a, b, c* to provide an exposed surface 84 having a substantially identical appearance with a similarly non-homogenous fabricated surface. It is also to be understood, of course, that a person can select a material 82 to provide an exposed surface 84 with an appearance which is merely compatible with the appearance of the fabricated surface 14. For example, the user may prefer a material which completes a pattern in the overall landscape, or which creates a readily visible marker.

The cap member 70*a, b, c* may be provided with a plurality of drain holes 86*a, b, c* for draining moisture from the material 82 placed within the top cavity 80*a, b, c,* and a plurality of support posts 88*a, b, c* attached to the bottom plate 78*a, b, c* and lateral wall 90*a, b, c* for stiffening the lateral wall 90*a, b, c* and anchoring the material 82 within the top cavity 80*a, b, c*. Although two drain holes 86*a, b, c* and four support posts 88*a, b, c* are shown in FIGS. 5–6, 8–9 and 11–12, it is, of course, recognized that the cap member 70*a, b, c* can be provided with one or more drain holes 86*a, b, c* or support posts 88*a, b, c.*

Figure 5:
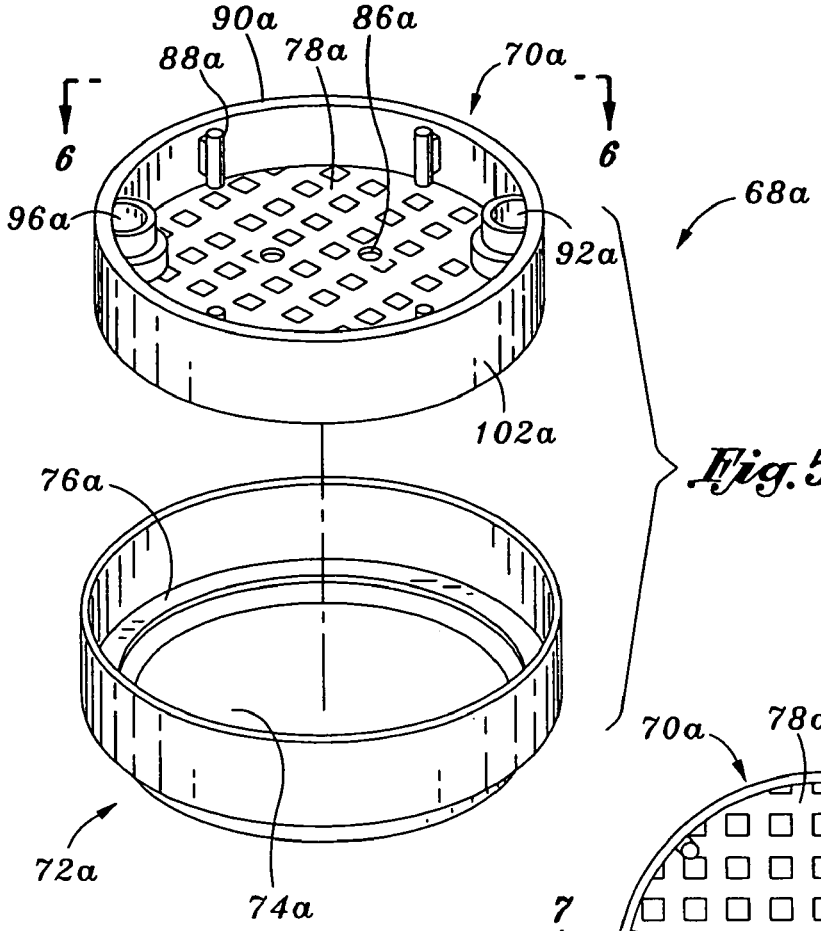
FIG. 5 is an exploded view of the first embodiment of the cover/access assembly shown in FIG. 2.
Figure 6:
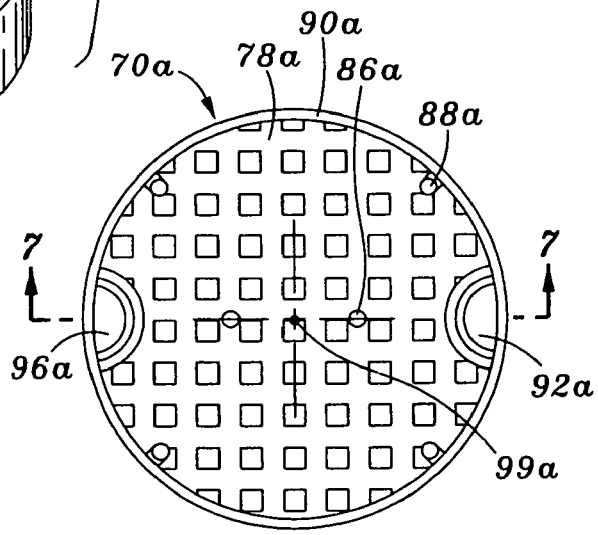
FIG. 6 is a top view of a cap member illustrated in FIG. 5.
Figure 7:
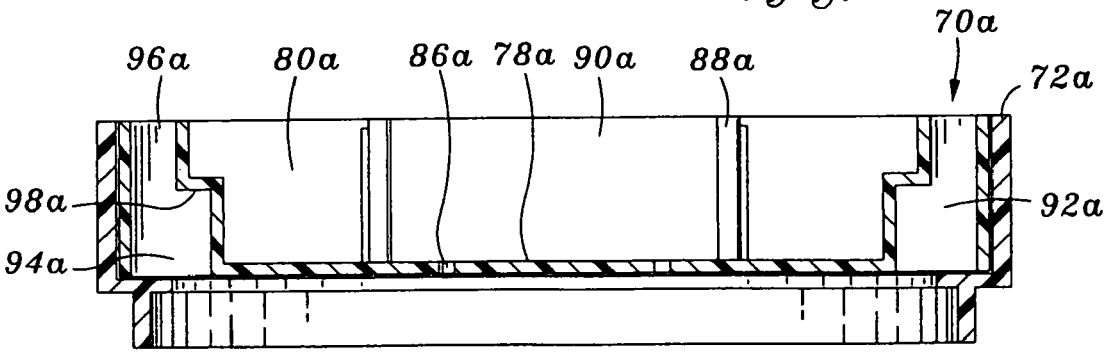
FIG. 7 is a front cross sectional view of the cover illustrated in FIGS. 5 and 6.

Referring now to FIGS. 5–7, a first embodiment of the cap member 70*a* may also be provided with hollow finger grip tubes 92*a* having holes 96*a* extending through the material 82 to a flared bottom cavity 94*a* (see FIG. 7). The tubes 92*a*, and more particularly, the flared bottom cavity 94*a* may have a grip surface 98*a* (see FIG. 7) to provide a finger hold for lifting the cap member 70*a* and material 82 from the access opening.

Figure 8:
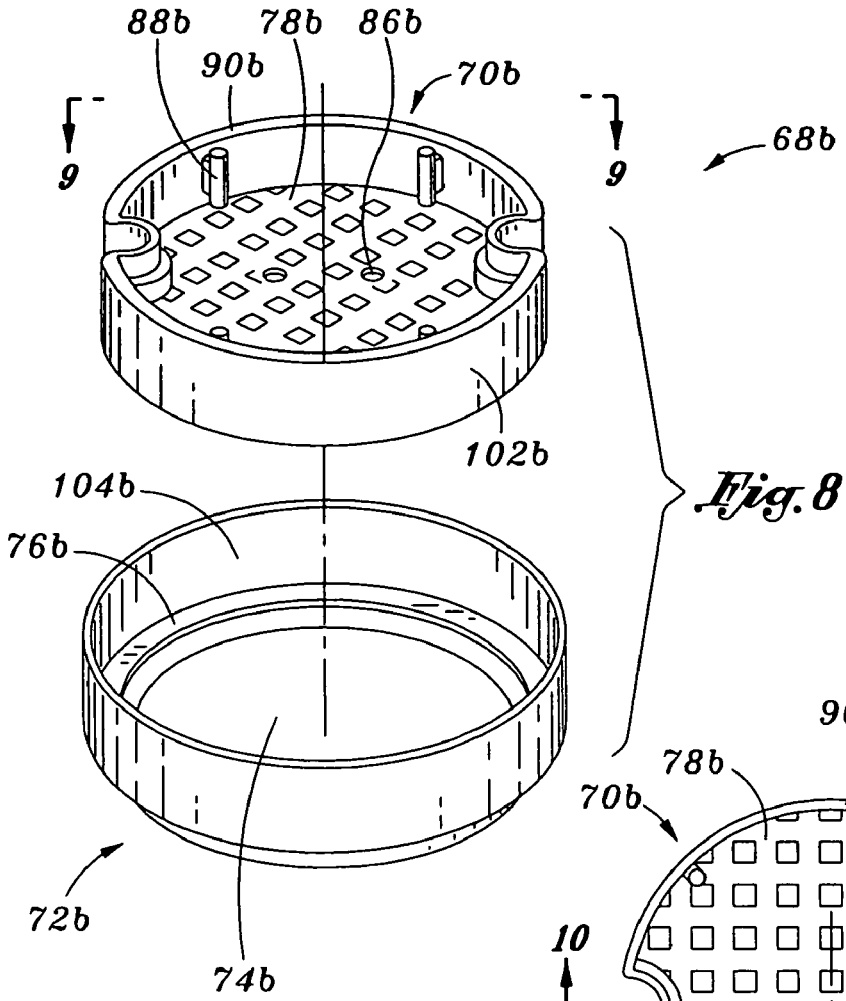
FIG. 8 is an exploded view of a second embodiment of a cover/access assembly.
Figure 9:
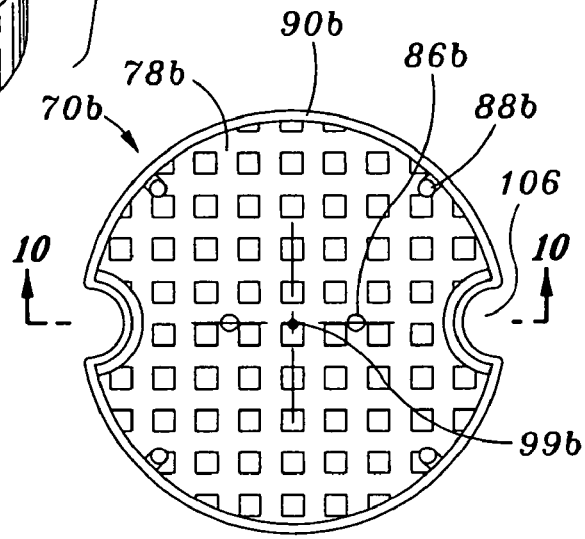
FIG. 9 is a top view of a cap member illustrated in FIG. 8.
Figure 10:
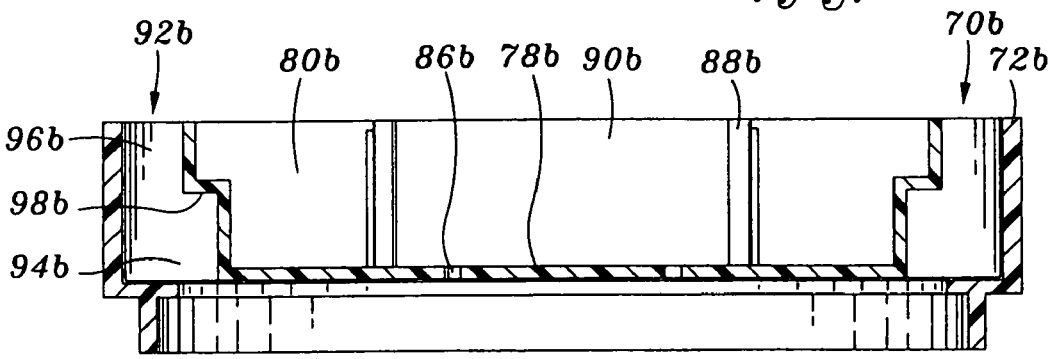
FIG. 10 is a front cross sectional view of the cover illustrated in FIGS. 8 and 9.

Referring now to FIGS. 8–10, a second embodiment of the cap member 70*b* and frame 72*b* may be provided which collectively form hollow finger grip tubes 92*b* (see FIG. 10) having holes 96*b* (see FIG. 10) extending through the material 82 to a flared bottom cavity 94*b*. The tubes 92*b*, and more particularly, the flared bottom cavity 94*b* may have a grip surface 98*b* (see FIG. 10) to provide a finger hold for lifting the cap member 70*b* and material 82 from the access opening.

The holes 96*b* as well as the flared bottom cavity 94*b* are defined by both the cap member 70*b* and the frame 72*b*. More particularly, the hole 96*b* may be defined by the lateral wall 90*b* of the cap member 70*b* and the side support 104*b* (see FIG. 8) of the frame 72*b*. As shown in FIG. 9, the lateral wall 90*b* may have at least one recess 106. The recess 106 when viewed from the top may have a semi circular configuration. The recess defines the inner periphery of the hole 96*b*. The outer periphery of the hole 96*b* may be defined by the side support 104*b* of the frame 72*b*.

The flared bottom cavity may also be defined by the lateral wall 90*b* and the side support 104*b*. The inner periphery of the flared bottom cavity 94*b* may be an undercut formed in relation to the hole 96*b*, as shown in FIG. 10. The outer periphery of the flared bottom cavity 94*b* may be defined by the side support 104*b* of the frame 72*b*.

Figure 11:
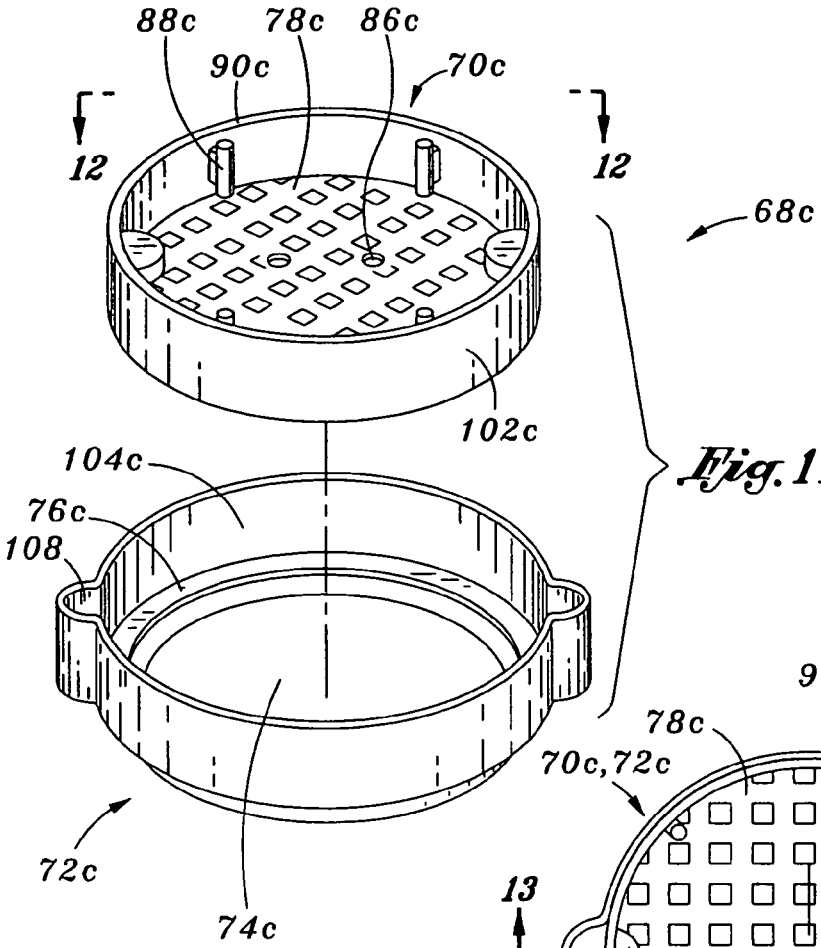
FIG. 11 is an exploded view of a third embodiment of a cover/access assembly.
Figure 12:
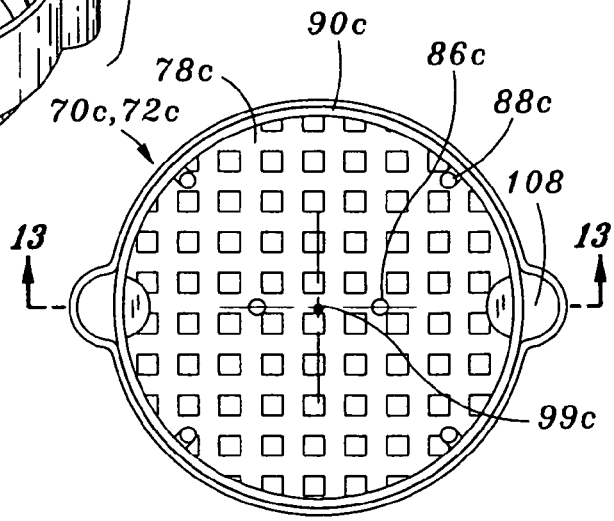
FIG. 12 is a top view of a cap member and a frame illustrated in FIG. 11.
Figure 13:
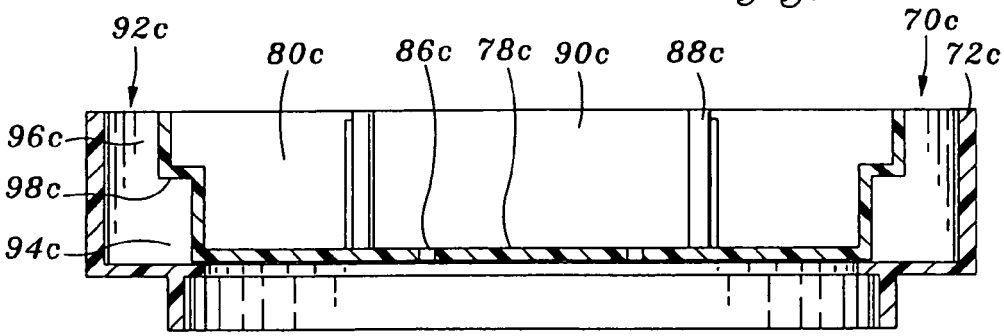
FIG. 13 is a front cross sectional view of the cover illustrated in FIGS. 11 and 12.

Referring now to FIGS. 11–13, a third embodiment of the cap member 70*c* and frame 72*c* may be provided which also collectively form hollow finger grip tubes 92*c* (see FIG. 13) having holes 96*c* (see FIG. 13) extending through the material 82 to a flared bottom cavity 94*c*. The tubes 92*c*, and more particularly, the flared bottom cavity 94*c* may have a grip surface 98*c* (see FIG. 10) to provide a finger hold for lifting the cap member 70*c* and material 82 from the access opening.

The holes 96*c* as well as the flared bottom cavity 94*c* may be collectively defined by both the cap member 70*c* and the frame 72*c*. More particularly, the hole 96*c* may be defined by the lateral wall 90*c* of the cap member 70*c* and the side support 104*c* (see FIG. 11) of the frame 72*c*. As shown in FIG. 12, the side support 104*c* of the frame 72*c* may have at least one recess 108. The recess 108 when viewed from the top may have a semi circular configuration. The recess defines the outer periphery of the hole 96*c*. The inner periphery of the hole 96*c* may be defined by the lateral wall 90*c* of the cap member 70*c*.

The flared bottom cavity 74*c* may also be defined by the lateral wall 90*c* and the side support 104*c*. The inner periphery of the flared bottom cavity 94*c* may be an undercut formed at the periphery of the cap member 70*c*. The outer periphery of the flared bottom cavity 94*c* may be defined by the side support 104*c* of the frame 72*c*.

In all three embodiments of the cap member 70*a, b, c* and frame 72*a, b, c,* the cap member 70*a, b, c* may have at least one hollow finger grip tubes 92*a, b, c*. Preferably, the cap member 70*a, b, c* has two hollow finger grip tubes 92*a, b, c*. Each hollow finger grip tube 92*a, b, c* may be located at distal ends or opposed sides of the cap member 70*a, b, c*. The hollow finger grip tubes 92*a, b, c* may be placed equidistantly from the center of gravity 99*a, b, c* (see FIG. 6, 9 and 12) of the cap member 70*a, b, c* after being filled with the material 82. In other words, a line connecting the two grip tubes 92*a, b, c* will cross substantially close to the center of gravity 99*a, b, c* of the cap member 70*a, b, c* filled with material 82. The line crosses substantially close to the center of gravity 99*a, b, c* of the cap member 70*a, b, c* as long as the human hand, finger or other picking device may lift the cap member 70*a, b, c* from the access opening. Referring now only to the first embodiment (see FIGS. 5–7) and the second embodiment (see FIGS. 8–10), the tubes 92*a, b* from a top view may have a circular configuration or a semicircular configuration (see FIGS. 6 and 9). The circular portions of the semicircularly configured tubes 92*a, b* may be directed toward the center of gravity 99*a, b* of the cap member 70*a, b*. Referring now only to the third embodiment (see FIGS. 11–13), the tube 92*c* from a top view may also have a semi circular configuration (see FIG. 12. However, the circular portions of the semicircularly configured tube 92*c* may be directed away the center of gravity 99*c* of the cap member 70*c*.

In use, the cap member 70 is placed within the frame 72 as shown in FIG. 2. Depending on the materials selected to construct the cover 68 and fabricated surface 14, it may be advantageous to wrap a self-adhering tape around the outer peripheral wall 102*a, b, c* (see FIGS. 5, 8, 11) of the cap member 70*a, b, c* prior to inserting the cap member 70*a, b, c* in the frame 72*a, b, c*. When so applied, the self-adhering tape prevents material from bonding to the cap member 70*a, b, c* and additionally minimizes the amount of excess material which may enter the gap between the frame 72*a, b, c* and cap member 70*a, b, c*.

Once the cap member 70*a, b, c* is engaged within the frame 72*a, b, c*, the assembly is placed within the intended plane of the fabricated surface as shown in FIG. 2. The assembly is then positioned and leveled so the cap member 70*a, b, c* will ultimately seat in a substantially level and flush position with the fabricated surface 14. To obtain a level and flush position with the fabricated surface, it may be necessary to countersink the frame 72*a, b, c* into the base 101 (see FIG. 2) upon which the fabricated surface 14 will be constructed. The correct orientation for the frame 72*a, b, c* and cap member 70*a, b, c* can also be verified with a level placed across the cap member 70*a, b, c*.

After the assembly is correctly positioned, the fabricated surface 14 is installed around the frame 72*a, b, c*, and a material 82 is placed within the top cavity 80*a, b, c* of the cap member 70*a, b, c*. The exposed surface 84 of the material 82 typically must be smoothed and leveled so the cover 68*a, b, c* will seat in a level and flush position with the surrounding fabricated surface 14.

Once the material 82 has sufficiently stabilized within the cavity 80*a, b, c*, the cover 68*a, b, c* is removed from the frame 72*a, b, c*, the tape (if applied) is removed from the cap member 70*a, b, c*, and any excess material is cleaned from the frame 72*a, b, c* and the cap member 70*a, b, c*. The time required for stabilization will depend on the selected material 82, however, persons skilled in the art will recognize that the cover 68*a, b, c* typically should not be removed from the frame 72*a, b, c* until it is certain that the material 82 will remain in the cavity 80*a, b, c* of the cap member 70*a, b, c* and that the exposed surface 84 remain smoothed and level. The cap member 70*a, b, c* is then reinserted within the frame 72*a, b, c* for final placement until access is required.

In this manner, access is provided for critical utilities disposed underneath the cover 68*a, b, c* such as for cleaning the filter 26*a*. In addition, the cover 68*a, b, c* can be constructed from a material 82 which provides an exposed surface 84 having an appearance substantially identical with the fabricated surface 14. Moreover, the functional properties of the exposed surface 84 will also be compatible with those of the fabricated surface 14 if the cover 68*a, b, c* is constructed from the same material as the fabricated surface 14. Furthermore, the cover 68*a, b, c* is custom fabricated to better match with the great variety of different fabricated surfaces. While it is recognized that an illustrative and presently preferred embodiment of the invention has been described in detail herein, it is likewise to be understood that the inventive concepts may be otherwise embodied and employed and that the appended claims are intended to be construed to include such variations except insofar as limited by the prior art.

What is claimed is:

1. A skimmer system attached to a tank having fluid therein, the fluid in the tank defining a tank fluid surface, the system comprising:

a) a reservoir to receive fluid from the tank, the fluid in the reservoir defining a reservoir fluid surface, the level of the reservoir fluid surface being maintainable below the level of the tank fluid surface;

b) an inlet defining an inlet edge, the inlet being positioned adjacent the tank to transfer the fluid from the tank to the reservoir, the inlet edge being located below the level of the tank fluid surface;

c) an inlet surface disposed between the inlet edge and the reservoir;

d) a reservoir pump connected to the reservoir to transfer fluid from the reservoir to the tank; and e) a weir defining a weir edge, the weir being maintained substantially gapped above the inlet surface to allow particulate in the fluid to pass under the weir when the reservoir pump is activated and the weir edge is maintained substantially below the level of the tank fluid surface to prevent particulate on the fluid from passing under the weir when the reservoir pump is deactivated.

2. The skimmer system of claim 1 wherein the inlet surface declines away from the tank.

3. The skimmer system of claim 2 wherein an angle of declination is about 20 degrees.

4. The skimmer system of claim 2 wherein the inlet surface has a stair stepped configuration.

5. The skimmer system of claim 2 wherein the inlet surface has a convex configuration.

6. The skimmer system of claim 2 wherein the weir edge is positioned over the inlet surface.

7. The skimmer system of claim 1 wherein the weir edge is positioned on the effluent side of the inlet with respect to the inlet edge.

8. The skimmer system of claim 1 wherein the reservoir pump is sized such that the level of the reservoir fluid surface is about three inches below the level of the tank fluid surface when the fluid transfer rate of the inlet is equal to the fluid transfer rate of the reservoir pump.

9. The skimmer system of claim 1 further comprising a conical tray attached to the reservoir with an aperture at the center of the tray, the aperture being sized and configured to receive and secure a filter, the conical tray located below the inlet so as to receive the fluid transferred through the inlet.

10. The skimmer system of claim 1 further comprising an overflow valve attached to the reservoir about one inch above the inlet edge for draining fluid from the reservoir and tank.

11. The skimmer system of claim 1 further comprising:

a cover for closing a utility access opening formed in a fabricated surface surrounding the tank and positioned above a filter, the access opening extending through the fabricated surface having an exposed appearance, the cover comprising:

a cap member engagable within the opening, the cap member having a top cavity adapted to receive a selected material having an appearance similar to the exposed appearance of the fabricated surface, the cap member further having at least one hand engagable grip for lifting the cap member and the selected material placed in the top cavity from the opening;

wherein the cap member with the material disposed within the cavity thereof provides an appearance substantially identical to the exposed appearance of the fabricated surface.

12. The skimmer system of claim 1 further comprising a fluid level regulator which monitors the reservoir fluid surface and controls an inlet fluid valve to maintain the level of the reservoir fluid surface sufficiently below the level of the tank fluid surface.

13. The skimmer system of claim 1 further comprising:

a) an inlet fluid valve for introducing fluid from an outside source; and b) a fluid level regulator for sensing the level of the reservoir fluid surface;

c) wherein the fluid level regulator is operative to open the inlet fluid valve when the fluid level regulator senses that the level of the reservoir fluid surface is more than three inches below the level of the tank fluid surface.

14. The skimmer system of claim 13 wherein the fluid level regulator is operative to close the inlet fluid valve when the fluid level regulator senses that the level of the reservoir fluid surface is about three inches below the level of the tank fluid surface.

15. A skimmer system attached to a tank having fluid therein, the fluid in the tank defining a tank fluid surface, the system comprising:

a) a reservoir to receive fluid from the tank, the fluid in the reservoir defining a reservoir fluid surface, the level of the reservoir fluid surface being maintainable below the level of the tank fluid surface;

b) an inlet defining an inlet edge and a fluid transfer rate, the inlet being positioned adjacent the tank to transfer the fluid from the tank to the reservoir;

c) a reservoir pump connected to the reservoir to transfer fluid from the reservoir to the tank;

d) a filter between the inlet and the reservoir to retain particulate within the fluid; and e) a fluid level regulator which monitors the reservoir fluid surface and controls the reservoir pump to maintain the level of the reservoir fluid surface below the level of the tank fluid surface wherein the fluid level regulator activates the reservoir pump when the level of the reservoir fluid surface is not substantially below the level of the tank fluid surface.

16. The skimmer system of claim 15 wherein the level of the reservoir fluid surface is not substantially below the level of the tank fluid surface when the level of the reservoir fluid surface is less than about three inches below the level of the tank fluid surface.

17. The skimmer system of claim 15 wherein the fluid level regulator de-activates the reservoir pump when the level of the reservoir fluid surface is more than about three inches below the level of tank fluid surface.

18. The skimmer system of claim 15 wherein the fluid transfer rate of the inlet is equal to the fluid transfer rate of the reservoir pump.

19. A skimmer system attached to a tank having fluid therein, the fluid in the tank defining a tank fluid surface, the system comprising:

a) a reservoir to receive fluid from the tank, the fluid in the reservoir defining a reservoir fluid surface, the level of the reservoir fluid surface being maintainable below the level of the tank fluid surface;

b) an inlet defining an inlet edge, the inlet being positioned adjacent the tank to transfer the fluid from the tank to the reservoir, the inlet edge being located below the level of the tank fluid surface;

c) a reservoir pump connected to the reservoir to transfer fluid from the reservoir to the tank; and d) a weir defining a weir edge, the weir edge being maintained substantially gapped above the inlet edge to allow particulate in the fluid to pass under the weir and the inlet edge when the reservoir pump is activated and substantially below the level of the tank fluid surface to prevent particulate on the fluid from passing under the weir when the reservoir pump is deactivated.

20. A skimmer system attached to a tank fillable with fluid supplied by an inlet fluid valve, the fluid in the tank defining a tank fluid surface, the system comprising:

a) a reservoir to receive fluid from the tank, the fluid in the reservoir defining a reservoir fluid surface, the level of the reservoir fluid surface being maintainable below the level of the tank fluid surface;

b) an inlet defining an inlet edge and a fluid transfer rate, the inlet being positioned adjacent the tank to transfer the fluid from the tank to the reservoir;

c) a reservoir pump connected to the reservoir to transfer fluid from the reservoir to the tank;

d) a filter between the inlet and the reservoir to retain particulate within the fluid; and e) a fluid level regulator which monitors the reservoir fluid surface and controls the inlet fluid valve to maintain fluid in the reservoir to prevent a dry pump situation.

* * * * *